US005337446A

United States Patent [19]

Smith et al.

[11] Patent Number: 5,337,446

[45] Date of Patent: Aug. 16, 1994

[54] APPARATUS FOR APPLYING ULTRASONIC ENERGY IN PRECISION CLEANING

[75] Inventors: Charles W. Smith, Fairview, Pa.; Thomas B. Stanford, Jr., San Pedro, Calif.

[73] Assignees: Autoclave Engineers, Inc., Erie, Pa.; Hughes Aircraft Company, Los Angeles, Calif.

[21] Appl. No.: 967,261

[22] Filed: Oct. 27, 1992

[51] Int. Cl.[5] ..... B08B 11/02

[52] U.S. Cl. ..... 15/21.1; 15/3; 15/4; 134/147; 134/184

[58] Field of Search ..... 15/1, 3, 4, 21.1, 88.4; 134/1, 147, 184; 366/127; 68/355; 204/157.42

[56] References Cited

U.S. PATENT DOCUMENTS

| | | | |
|---|---|---|---|
| 2,950,725 | 8/1960 | Jacke et al. | 134/184 |
| 3,240,963 | 3/1966 | Sasaki | 134/1 |
| 3,318,578 | 5/1967 | Branson | 134/1 |
| 3,520,724 | 7/1970 | Massa | 134/184 |
| 3,985,344 | 12/1976 | McCord | 366/127 |
| 4,561,902 | 12/1985 | Lee | 134/147 |

FOREIGN PATENT DOCUMENTS

| | | | |
|---|---|---|---|
| 838581 | 6/1960 | United Kingdom | 134/1 |

*Primary Examiner*—Edward L. Roberts
*Attorney, Agent, or Firm*—Webb Ziesenheim Bruening Logsdon Orkin & Hanson

[57] ABSTRACT

An apparatus for applying ultrasonic energy in precision cleaning includes a pressure vessel having a plurality of sonic plates, with or without a rotary device located inside the vessel. The plates may be arranged centrally within the vessel to propagate sonic waves outward, or the plates may be located on an interior wall in the pressure vessel, directed inward. Each plate includes a plurality of sonic transducers, spaced along the longitudinal axis of the pressure vessel. The rotary device may include a plurality of arms carrying removable brush holders or a rotating parts basket. In either case, the device is driven by a motor mounted in a top cover of the pressure vessel. A liquid cleaning fluid, preferably carbon dioxide, is charged in the pressure vessel to submerge the sonic plates and workpieces secured in the pressure vessel. The transducers are then energized and the rotary device engaged to apply both sonic and mechanical agitation to the workpieces for enhanced removal of particulates. The sonic application may be preceded or followed by pressurization of the pressure vessel to above the supercritical pressure of the carbon dioxide for removing dissolvable contaminants from the workpieces.

20 Claims, 3 Drawing Sheets

APPARATUS FOR APPLYING ULTRASONIC ENERGY IN PRECISION CLEANING

BACKGROUND OF THE INVENTION

1. Field of the Invention

This application is related to precision cleaning systems and, more particularly, apparatus for cleaning parts with supercritical fluids and applying sonic energy to the parts as a supplemental cleaning technique.

2. Description of the Prior Art

Today's manufacturing and assembly industries require parts which have a high degree of cleanliness. These requirements have led to development of an independent area of technology known as "precision cleaning". Precision cleaning may be defined as cleaning a given part to a degree that the level of foreign substances on the part meets a repeatably measurable standard. For example, parts which are to be chrome plated must be cleaned to a contaminant level of 20 micrograms per square centimeter, or less. Disc drive components for computers must be cleaned to a level less than 5 micrograms per square centimeter, and wafers utilized in the electronics industry must be cleaned to a level less than 1 microgram per square centimeter. In addition, there may also be a limit on the number of particulates of a certain size or larger which may be left on the part. For example, a typical specification may require that no more than 5,000 particles having a size greater than 2 microns should remain on the part. The various contaminants removed by precision cleaning include dissolvables, such as cutting fluid, particulates, such as diamond dust, and ionic bindings. Applications for precision cleaning include the manufacture of pens, razors and computer chips as well as various electronics industry applications.

The problem with presently available precision cleaning systems is that they use chlorofluorocarbons (CFC's) which are considered to destroy the earth's ozone layer. A system which utilizes CFC's is disclosed in U.S. Pat. No. 4,443,269 to Capella, et al. ("Capella"). Capella discloses a decontamination method for radioactive tools utilizing a high pressure spray gun for spraying the contaminated tools with freon. The general solution is to utilize more benign cleaning solvents, such as carbon dioxide. Carbon dioxide is particularly advantageous because it is a nonpolar solvent so that cosolvents may be added for a high degree of selectivity. It has been found that the cleaning capability of solvents such as carbon dioxide is enhanced when the solvent is raised to supercritical temperatures and pressures, or when supplemental cleaning techniques are utilized, such as sonic treatment.

The general concept of cleaning with supercritical fluids is known in the art. U.S. Pat. No. 5,013,366 to Jackson, et al. ("Jackson") discloses a cleaning process using phase shifting of dense phase gases. The solvent is shifted from its critical state to the liquid state and back by temperature adjustment while the solvent is in contact with the part to be cleaned. The cleaning apparatus utilized in Jackson is shown in FIG. 6.

Jackson schematically discloses and briefly discusses a cleaning vessel having an ultrasonic transducer in FIG. 8 and column 11, lines 36–50. However, Jackson does not teach or suggest the sonic arrangement according to the present invention. Nor does Jackson teach or suggest sonic application combined with mechanical agitation, which has been found particularly advantageous for removing sub-micron particulates.

It is an object of the present invention to provide an apparatus for applying sonic energy in combination with supercritical cleaning to enhance the cleanliness of the workpiece. It is a further object to add mechanical agitation in combination with sonic energy to assist in removing sub-micron particulates from the workpiece. It is a still further object to provide an apparatus which locates the workpiece, the sonic generation equipment and optional mechanical agitation equipment within a pressure vessel in such a way that supercritical cleaning fluid, sonic energy and mechanical agitation may be serially applied to the workpiece without the necessity of moving the workpiece from one station to another.

SUMMARY OF THE INVENTION

Briefly, according to this invention, there is provided an apparatus for applying ultrasonic energy in precision cleaning, including a pressure vessel for receiving a workpiece and submerging the workpiece in cleaning fluid. At least one sonic plate is located in the pressure vessel, and the plate has a plurality of sonic transducers, spaced in the direction of the longitudinal axis of the pressure vessel. The sonic transducers are also submerged in the cleaning fluid and are positioned to emit sonic waves in the cleaning fluid. The apparatus may also include a rotary brushing device or rotating parts basket for mechanically agitating the workpiece to assist in removing particulates. Means for supporting the workpiece in the pressure vessel are provided so that the workpiece may be mechanically agitated and simultaneously exposed to the sonic waves. A drive mechanism, mounted in a top cover of the pressure vessel, is removably coupled to an upstanding driving post on the rotary device for rotating the device.

The apparatus may include at least three sonic plates in the pressure vessel secured to an upstanding support post. The sonic plates define an angular sonic tower, with sonic transducers directed radially outward from the support post. The support post itself may serve as a conduit for introducing cleaning fluid into the pressure vessel. A diffuser may be positioned adjacent an upper end of the support post for diffusing incoming cleaning fluid.

A second embodiment of the invention includes at least one sonic plate mounted on an interior wall in the pressure vessel, with the sonic transducers directed radially inward toward the longitudinal axis of the pressure vessel. In this embodiment, the workpiece will be located in the central portion of the pressure vessel, with sonic waves directed inward to converge at the center of the pressure vessel.

Larger pressure vessels would require more numerous sonic plates and, in the first embodiment of the invention, the sonic tower may take the shape of a triangle, a square, an octagon or other suitable shape depending upon the size of the pressure vessel. The sonic application, in combination with mechanical agitation and preceded or followed by supercritical cleaning, provides a maximum degree of cleanliness to the workpieces.

Other details and advantages of the present invention will become apparent from the following detailed description and accompanying drawings.

DETAILED DESCRIPTION OF THE PREFERRED EMBODIMENTS

Figure 1:
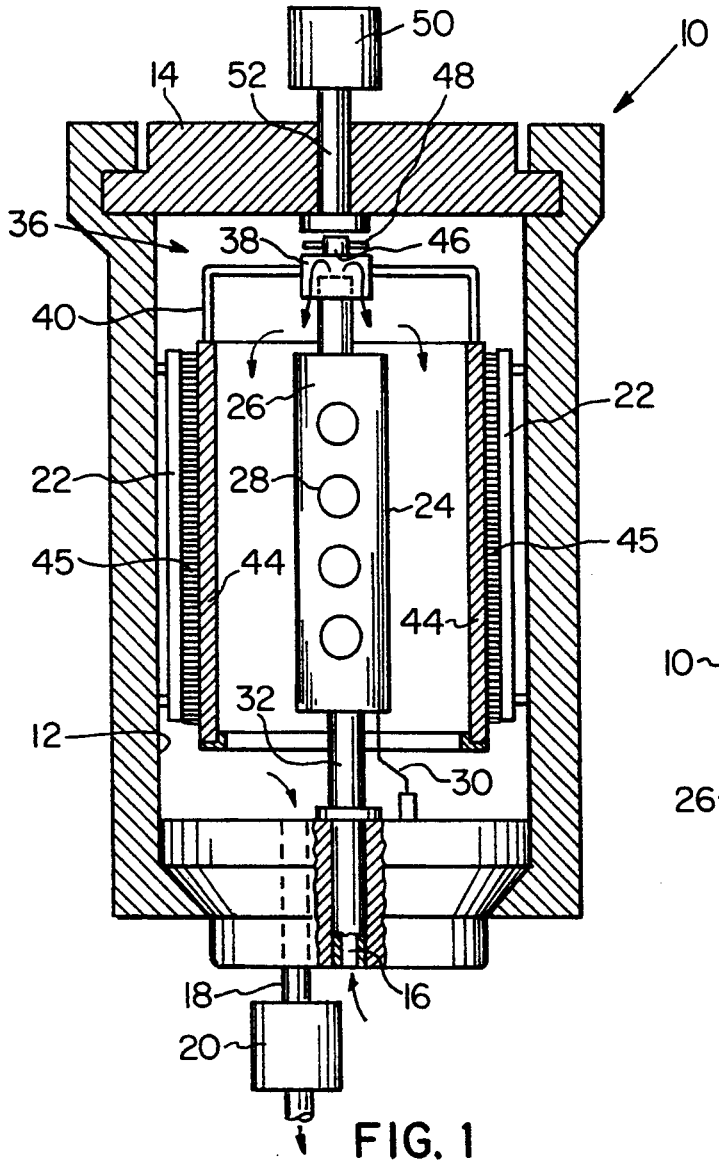
FIG. 1 is an elevation view in partial section showing a pressure vessel having an apparatus for sonic cleaning in accordance with the present invention.
Figure 2:
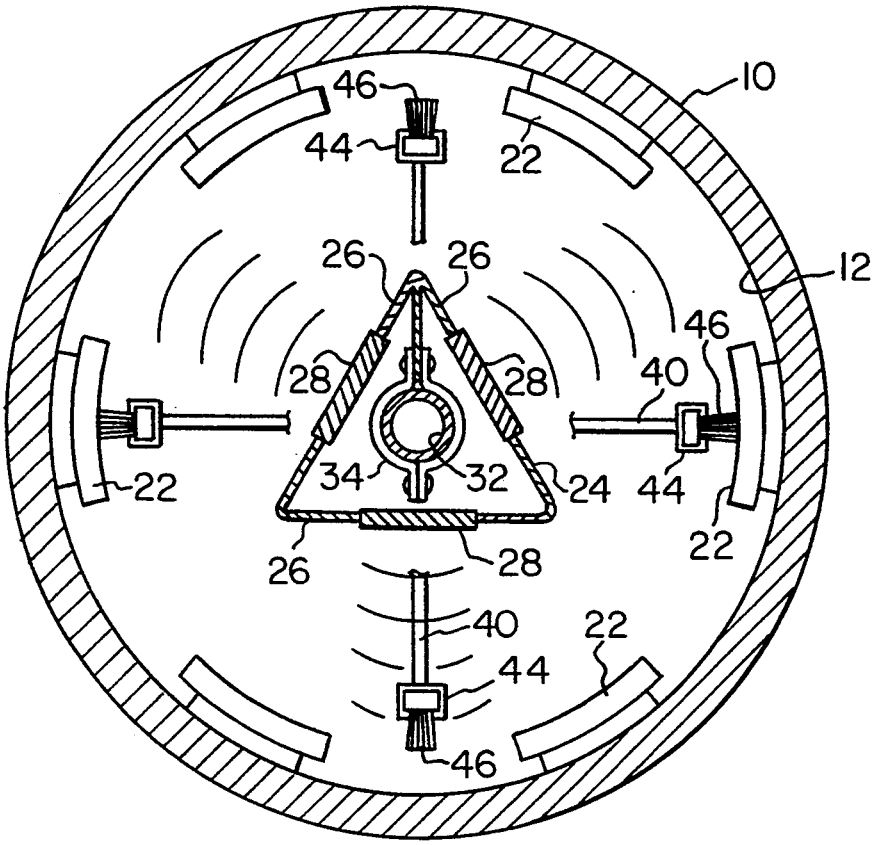
FIG. 2 is a plan view in partial section of the sonic tower and rotary brushing device of FIG. 1.

FIGS. 1 and 2 show a pressure vessel 10 having an interior wall 12 and a removable top cover 14. An inlet 16 admits cleaning fluid to the pressure vessel, and cleaning fluid is withdrawn through outlet 18. A removable filter 20 is located inline with outlet 18 for filtering particulate from the spent cleaning fluid. A suitable workpiece rack 22 is provided for holding the workpieces (not shown) in a secure manner. Further details regarding pressure vessels with which the invention may be utilized are disclosed in Applicants' copending application entitled "Apparatus for Supercritical Cleaning" filed simultaneously herewith and incorporated herein by reference.

A sonic tower 24 is centrally located in the pressure vessel 10. The sonic tower comprises three sonic plates 26 arranged to define an elongated triangle. Each modular sonic plate 26 includes four transducers 28, and electric power is supplied to the transducers by power lead 30. Suitable sonic plates and transducers are provided by L and R Manufacturing Co. of Kearny, N.J. The sonic plates 26 are secured to an upstanding support post 32 by clamps 34. The support post 32 may also serve as a conduit for introducing cleaning fluid to the pressure vessel from inlet 16.

A rotary brushing device 36 is disposed in the pressure vessel concentric with the sonic tower 24. The brushing device includes an upper hub 38 with four arms 40 extending therefrom. The arms 40 are captured in a lower guide track 42. Each am has a vertically extending brush holder 44. A replaceable brush 45 is slideably captured in each holder.

The hub 38 has an upstanding drive post 46 with a pair of splines 48 extending from the drive post. A motor 50 is mounted in the top cover 14 with a drive coupling 52 extending through the top cover. The drive coupling removably receives the splines 48 to rotate the post 46 and arms 40 for brushing the workpieces. The motor is operable to rotate the arms 40 in both directions.

Figure 6:
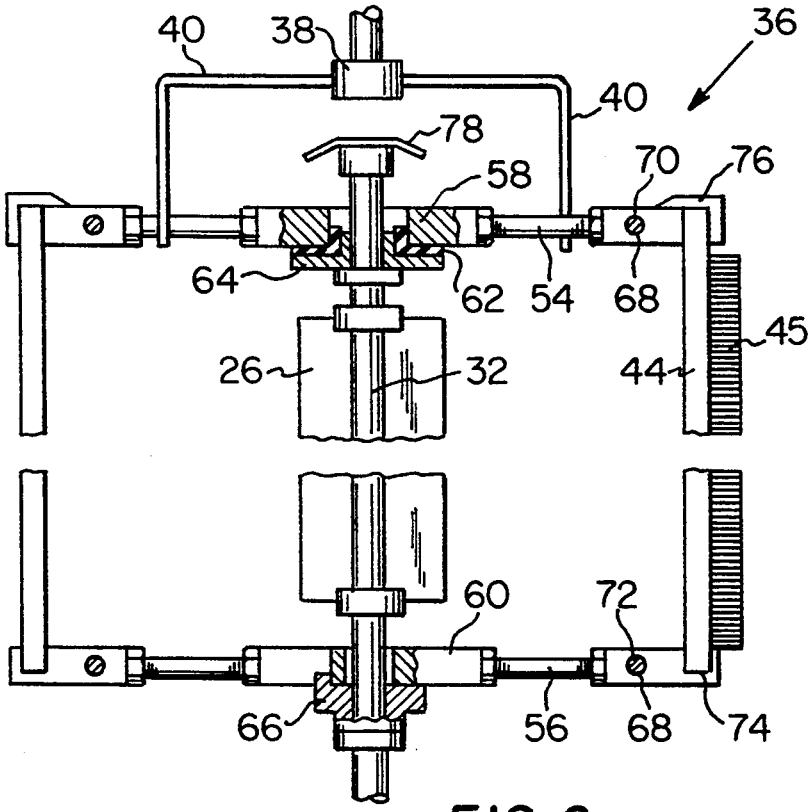
FIG. 6 is an elevation in partial section showing an alternative rotary brushing device.

FIG. 6 shows an alternative brushing device 36' for use with the first embodiment of the invention. In this arrangement, upper and lower struts 54, 56 extend from upper and lower centering rings 58, 60. The rings ride on Teflon TM bearing pads 62, which are interposed between the rings and upper and lower flanges 64, 66. The flanges are secured to support post 32.

The outer ends of struts 54, 56 have eyelets 68 which slideably receive upper and lower stability rings 70, 72. The lower struts 56 include a brush seat 74 at their outermost end. Correspondingly, the upper struts 54 include pivoting swing clamps 76. A brush holder 44 is removably captured between each swing clamp 76 and brush seat 74 for brushing the workpieces.

Arms 40, extending from hub 38, contact the struts 54 to rotate the brushing device 36'. Although not shown, a motor, drive post, coupling and splines are also provided, similar to the device described in connection with FIG. 1.

Figure 4:
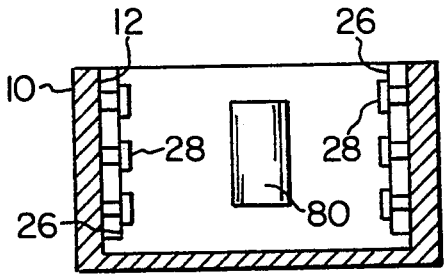
FIG. 4 is an elevation view in partial view of the apparatus in FIG. 3.
Figure 3:
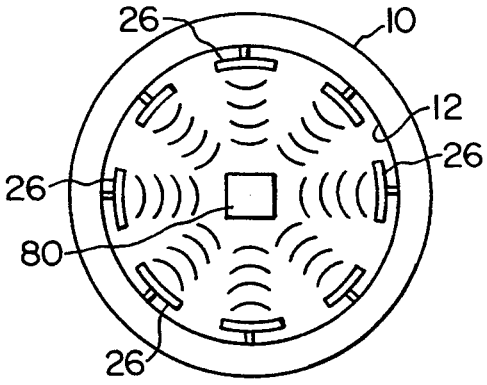
FIG. 3 is a plan view in partial section of a second embodiment of the invention.

A second embodiment of the invention is shown in FIGS. 3 and 4. Sonic plates 26 are mounted on interior wall 12 of the pressure vessel 10. The sonic plates are directed inward toward a workpiece 80, shown schematically in the center of the pressure vessel. Although not shown, it is contemplated that the second embodiment of the invention may be coupled with brushes or other mechanical agitation as shown and described in connection with the first embodiment.

In operation, with respect to the first embodiment, liquid carbon dioxide is pumped through inlet 16 upward through support post 32 and into the pressure vessel until the workpieces and the sonic tower 24 are both submerged in the liquid $CO_2$. Power is then supplied to the power leads 30 and sonic waves are produced by transducers 28. The sonic waves generally propagate radially outward from the support post 32 to essentially fill the liquid in the vessel with sonic energy. For larger pressure vessels, the sonic plates may be longer, or the sonic tower may be square, octagonal or any other suitable shape to adequately fill the liquid in the pressure vessel with sonic waves. Particularly, the wave direction, or general direction of wave propagation, is perpendicular to the longitudinal axis of the pressure vessel to ensure soaking of the entire vessel with sonic waves. The wave direction may be radially outward, as shown in the first embodiment, or radially inward, as in the second embodiment discussed below.

The sonic waves impinge on the workpieces located on rack 22 at the pressure vessel wall 12 to impart agitation to the workpieces. The agitation loosens particulates which fall from the workpieces into the liquid carbon dioxide bath. Optionally, the rotary brushing device is engaged during sonification to assist in removing loosened particulate from the workpieces. The arms 40 are rotated by motor 50 to sweep brushes 45 across the workpieces. The motor maybe periodically reversed to enhance the brushing effect.

Figure 5:
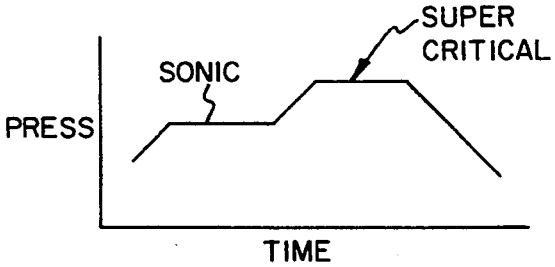
FIG. 5 is a graphic illustration of pressure versus time for serial sonic and supercritical cleaning.

After a sonic cleaning cycle is completed, the liquid may be drained through outlet 18, with particulates trapped in filter 20. Either before or after sonic cleaning, the pressure vessel can be pressurized to supercritical conditions to remove dissolvable contaminants, as discussed in the application hereinabove incorporated by reference. The pressurization may take place prior to draining the liquid $CO_2$. FIG. 5 displays the graph of pressure versus time for a cleaning sequence in which sonic is first applied, followed by a supercritical cleaning cycle. It is currently contemplated that sonic energy be applied in the pressure vessel at temperatures less than 31° C. and pressures less than 1,080 PSIA. Further development and the addition of cosolvents may require alternative operating temperatures and pressures.

Periodically, the top cover 14 is lifted from pressure vessel 10, and the drive coupling 52 is thereby disengaged from the splines 48 on drive post 46. The brushes 45 may then be slideably removed from brush holders 44 to replace worn brushes or to utilize brushes of varying stiffness.

With respect to the second embodiment of the invention, liquid carbon dioxide is also introduced to the pressure vessel 10 to submerge the workpieces 80 and sonic plates 26. Sonic transducers 28 are then activated to direct waves radially inward, perpendicular to the longitudinal axis of pressure vessel 10, with the waves converging at the workpiece 80 in the center of the pressure vessel 10. This embodiment of the invention is suitable for larger pressure vessels or for cleaning oversized or oddly shaped workpieces.

Figure 7:
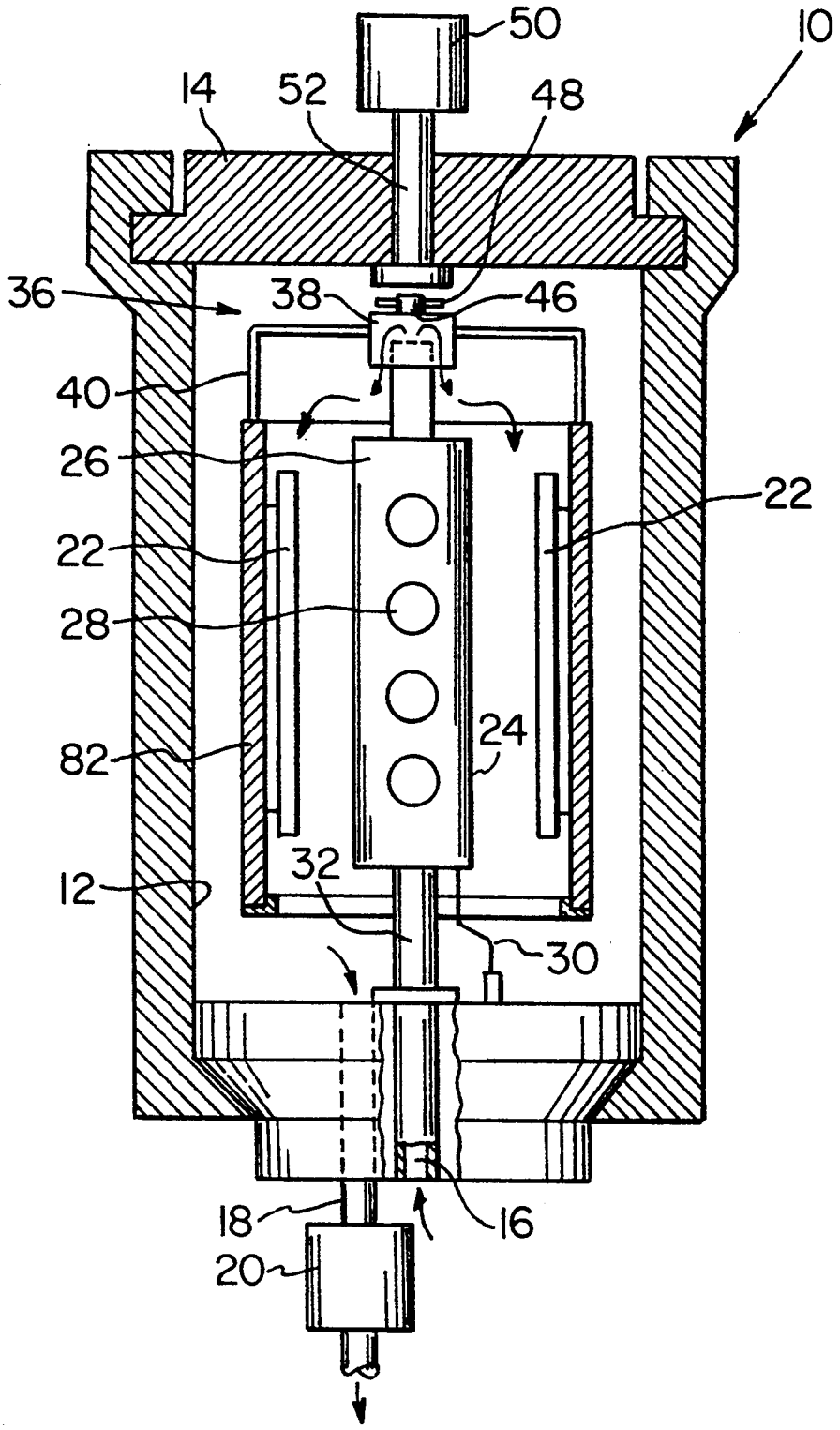
FIG. 7 is an elevation in partial section showing a third embodiment of the invention.

FIG. 7 shows a third embodiment of the invention which does not include brushes, but rather has a rotating parts basket 82 disposed in the pressure vessel 10. Racks 22 for the workpieces to be cleaned are mounted on the rotating basket 82, and in operation, the entire basket is submerged along with the sonic tower in liquid cleaning fluid. The basket 82 may be rotated before, during or after sonic application in the liquid cleaning fluid to provide mechanical agitation to the parts to be cleaned. This embodiment of the invention is useful for applications where the desired degree of particulate removal or the shape of the parts do not permit brushing. It will be apparent to those skilled in the art that other suitable arrangements may be employed for rotating the basket 82. A further alternative to brushing may include resting the basket 82 on a vibrating base to mechanically vibrate the basket and the parts within the liquid carbon dioxide.

Having described the presently preferred embodiments of the invention, it will be understood that it is not intended to limit the invention except within the scope of the following claims.

We claim:

1. An apparatus for applying ultrasonic energy to a workpiece, comprising:

a pressure vessel having a cylindrical wall, a bottom wall and a cover enclosing an elongate workspace, a longitudinal axis of the vessel passing through the workspace;

a cleaning fluid comprising liquified carbon dioxide within the workpiece such that the workpiece is submerged therein;

a sonic plate located in said pressure vessel and disposed in said cleaning fluid, said plate having a plurality of sonic transducers thereon;

said transducers spaced in the direction of a longitudinal axis of the pressure vessel and positioned to emit sonic waves in said cleaning fluid.

2. The apparatus of claim 1 including a rotating brushing device for brushing said workpiece to remove particulates therefrom and means for causing rotation of said rotating brushing device.

3. The apparatus of claim 2 including means for supporting said workpiece in said pressure vessel so that it may be simultaneously contacted by said brushing device and exposed to said sonic waves.

4. The apparatus of claim 2 in which the means for causing rotation comprises a drive mechanism in said pressure vessel having an axis parallel the longitudinal axis of the vessel, said drive mechanism releasably coupled to said rotating brushing device.

5. The apparatus of claim 1 including means for mechanically agitating said workpiece to remove particulates therefrom.

6. The apparatus of claim 5 including means for supporting said workpiece on a rotating device so that it may be simultaneously rotated with respect to said sonic plate in said cleaning fluid and exposed to said sonic waves.

7. The apparatus of claim 1 including at least three sonic plates in said pressure vessel, said plates defining an angular sonic tower, said sonic transducers directed radially outward from said tower.

8. The apparatus of claim 7 wherein said sonic tower is secured to a support post, said support post serving as a conduit for introducing cleaning fluid into said pressure vessel.

9. The apparatus of claim 1 including at least one sonic plate mounted on an interior wall in said pressure vessel, the sonic transducers on said plate directed radially inward toward the longitudinal axis of said pressure vessel.

10. An apparatus for applying ultrasonic energy to a workpiece, comprising:

a pressure vessel having a cylindrical wall, a bottom wall and a cover enclosing an elongate workspace, a longitudinal axis of the vessel passing through the workspace;

a cleaning fluid comprising liquified carbon dioxide within the workspace such that the workpiece is submerged therein;

a sonic plate located in said pressure vessel and submerged in said cleaning fluid, said plate having a plurality of sonic transducers thereon;

said transducers spaced in the direction of a longitudinal axis of the pressure vessel and positioned to emit sonic waves in said cleaning fluid; and means for mechanically agitating said workpiece to remove particulates therefrom.

11. The apparatus of claim 10 wherein said means for mechanically agitating the workpiece comprises a rotating device extending parallel to said longitudinal axis, a brush on said rotating device, and means for causing rotation of the rotating device.

12. The apparatus of claim 11 including means for supporting said workpiece in said pressure vessel so that it may be simultaneously contacted by said brush and exposed to said sonic waves.

13. The apparatus of claim 12 wherein said means for mechanically agitating the workpiece includes a rotating parts basket, which carries said workpieces and rotates them in said cleaning fluid.

14. The apparatus of claim 10 including at least three sonic plates in said pressure vessel, said plates defining an angular sonic tower, said sonic transducers directed radially outward from said tower.

15. An apparatus for applying ultrasonic energy to a workpiece, comprising:

a pressure vessel having a cylindrical wall, a bottom wall and a cover enclosing an elongate workspace, a longitudinal axis of the vessel passing through the workspace;

a cleaning fluid comprising liquified carbon dioxide within the workspace such that the workpiece is submerged therein;

a plurality of sonic plates centrally located in said pressure vessel, each plate having a plurality of sonic transducers thereon, said plates submerged in said cleaning fluid and arranged to define a sonic tower, said transducers spaced in the direction of a longitudinal axis of the pressure vessel;

said transducers directed radially outward from said tower to emit sonic waves in said liquid cleaning fluid;

means for mechanically agitating said workpiece to remove particulates therefrom; and means for supporting said workpiece in said pressure vessel so that it may be simultaneously agitated and exposed to said sonic waves.

16. An apparatus for applying ultrasonic energy to a workpiece, comprising:

a pressure vessel having a cylindrical wall, a bottom wall and a cover enclosing an elongate workspace, a longitudinal axis of the vessel passing through the workspace, a cleaning fluid within the workspace such that the workpiece is submerged therein;

at least three sonic plates located in said pressure vessel and disposed in said cleaning fluid, said plates having a plurality of sonic transducers thereon, said plates defining an angular sonic tower;

said transducers spaced in the direction of a longitudinal axis of the pressure vessel and said sonic transducers directed radially outward from said tower to emit sonic waves in said cleaning fluid.

17. The apparatus of claim 16 wherein said sonic tower is secured to a support post, said support post serving as a conduit for introducing cleaning fluid into said pressure vessel.

18. An apparatus for applying ultrasonic energy to a workpiece, comprising:

a pressure vessel having a cylindrical wall, a bottom wall and a cover enclosing an elongate workspace, a longitudinal axis of the vessel passing through the workspace;

a cleaning fluid within the workspace such that the workpiece is submerged therein;

a sonic plate located in said pressure vessel and submerged in said cleaning fluid, said plate having a plurality of sonic transducers thereon;

said transducers spaced in the direction of a longitudinal axis of the pressure vessel and positioned to emit sonic waves in said cleaning fluid; and a rotating device for mechanically agitating said workpiece to remove particulates therefrom there being a brush on said rotating device extending parallel to said longitudinal axis.

19. The apparatus of claim 18 including means for supporting said workpiece in said pressure vessel so that it may be simultaneously contacted by said brush and exposed to said sonic waves.

20. The apparatus of claim 18 including at least three sonic plates in said pressure vessel, said plates defining an angular sonic tower, said sonic transducers directed radially outward from said tower.

* * * * *

UNITED STATES PATENT AND TRADEMARK OFFICE

CERTIFICATE OF CORRECTION

PATENT NO. : 5,337,446

DATED : August 16, 1994

INVENTOR(S) : Charles W. Smith and
Thomas B. Stanford, Jr.

It is certified that error appears in the above-indentified patent and that said Letters Patent is hereby corrected as shown below:

Column 3 Line 49 "am" should read --arm--.

Column 4 Line 48 "maybe" should read --may be--.

Claim 1 Line 43 Column 5 "workpiece" (first occurrence) should read --workspace--.

Claim 13 Line 43 Column 6 "12" should read --10--.

Signed and Sealed this

Eighteenth Day of October, 1994

*Attest:*

Bruce Lehman

BRUCE LEHMAN

*Attesting Officer*

*Commissioner of Patents and Trademarks*